US005971077A

United States Patent [19]

Lilley

[11] Patent Number: 5,971,077

[45] Date of Patent: Oct. 26, 1999

[54] INSERT TREE

[75] Inventor: Robert O. Lilley, Farno, Italy

[73] Assignee: ABB Vetco Gray Inc., Houston, Tex.

[21] Appl. No.: 08/975,745

[22] Filed: Nov. 21, 1997

Related U.S. Application Data

[60] Provisional application No. 60/031,644, Nov. 22, 1996.

[51] Int. Cl.[6] ..... E21B 33/035; E21B 34/04

[52] U.S. Cl. ..... 166/368; 166/86.1; 166/89.1; 166/97.1; 166/348

[58] Field of Search ..... 166/344, 348, 166/368, 75.11, 86.1, 89.1, 95.1, 97.1

[56] References Cited

U.S. PATENT DOCUMENTS

| | | | |
|---|---|---|---|
| 2,092,261 | 9/1937 | Rector | 166/95.1 |
| 3,101,118 | 8/1963 | Culver et al. . | |
| 3,211,223 | 10/1965 | Hoch . | |
| 3,474,857 | 10/1969 | Newman et al. . | |
| 4,405,016 | 9/1983 | Best | 166/344 X |
| 5,143,158 | 9/1992 | Watkins et al. . | |
| 5,535,826 | 7/1996 | Brown et al. | 166/368 X |
| 5,575,336 | 11/1996 | Morgan | 166/95.1 |
| 5,868,204 | 2/1999 | Pritchett et al. | 166/368 |
| 5,873,415 | 2/1999 | Edwards | 166/344 |
| 5,884,706 | 3/1999 | Edwards | 166/75.11 X |

FOREIGN PATENT DOCUMENTS 2267920 12/1993 United Kingdom .

*Primary Examiner*—George Suchfield
*Attorney, Agent, or Firm*—James E. Bradley

[57] ABSTRACT

A subsea well has a an outer wellhead housing with a tree on an upper end and a tubing hanger landed in the bore of the tree. A tree cap lands on and is secured to the tree. The tree cap has a plurality of production and annulus valves and a dual-bore control pod assembly. The tree has annulus bypass passages which communicate with a tubing annulus on a lower end and upper ports in the tubing hanger on an upper end. Production fluids flow up the tubing hanger bore to the tree cap and circulates through a flowline in the control pod. Access to the tubing annulus is through the annulus passages and tree cap annulus passage to a separate flowline.

29 Claims, 2 Drawing Sheets

INSERT TREE

CROSS REFERENCE TO RELATED APPLICATIONS

This application claims the benefit of provisional application, Ser. No. 60/031,644 filed Nov. 22, 1996.

TECHNICAL FIELD

This invention relates in general to an insert tree and in particular to a subsea vertical flow insert tree.

BACKGROUND ART

A conventional subsea wellhead assembly includes a wellhead housing which supports one or more casing hangers located at upper ends of strings of casing extending into the well. A tubing hanger lands in the wellhead housing above the casing hanger and supports a string of production tubing that extends through the smallest diameter casing. The tubing hanger has a production bore which is offset slightly from the longitudinal axis. An annulus bore also extends through the tubing hanger, parallel to and offset from the axis, for communicating the tubing annulus to above the tubing hanger. The annulus bore is needed during installation of the tubing hanger and tubing to establish circulation down the tubing and back up the annulus. After the well has been completed, a removable plug is installed in the annulus bore, then a production tree is mounted to the wellhead housing. Access through the production tree to the tubing may be made for various workover operations that are needed.

In the last few years, operators have begun installing a different type of wellhead assembly, referred to generally as a horizontal tree. In a horizontal tree, the tubing hanger lands in the tree, not in the wellhead housing located below the tree. The tubing hanger has a lateral flow passage extending from its vertical flow passage. The lateral flow passage registers with a lateral flow passage extending through a sidewall of the tree. With the horizontal tree, a tubing hanger can be pulled through the horizontal tree without removing the tree. This cannot be done with a conventional tree.

With both conventional and horizontal trees, external chokes and production wing valves are used to control the flow. If the valves or chock are in need of service, retrieval is difficult and may require the use of a remotely operated vehicle.

DISCLOSURE OF THE INVENTION

A subsea well has a an outer wellhead housing with a tree on an upper end and a tubing hanger landed in the bore of the tree. A tree cap lands on and is secured to the tree. The tree cap has a plurality of production and annulus valves and a dual-bore control pod assembly. The tree has annulus bypass passages which communicate with a tubing annulus on a lower end and upper ports in the tubing hanger on an upper end. Production fluids flow up the tubing hanger bore to the tree cap and circulates through a flowline in the control pod. Access to the tubing annulus is through the annulus passages and tree cap annulus passage to a separate flowline.

DETAILED DESCRIPTION OF THE INVENTION

Figure 1:
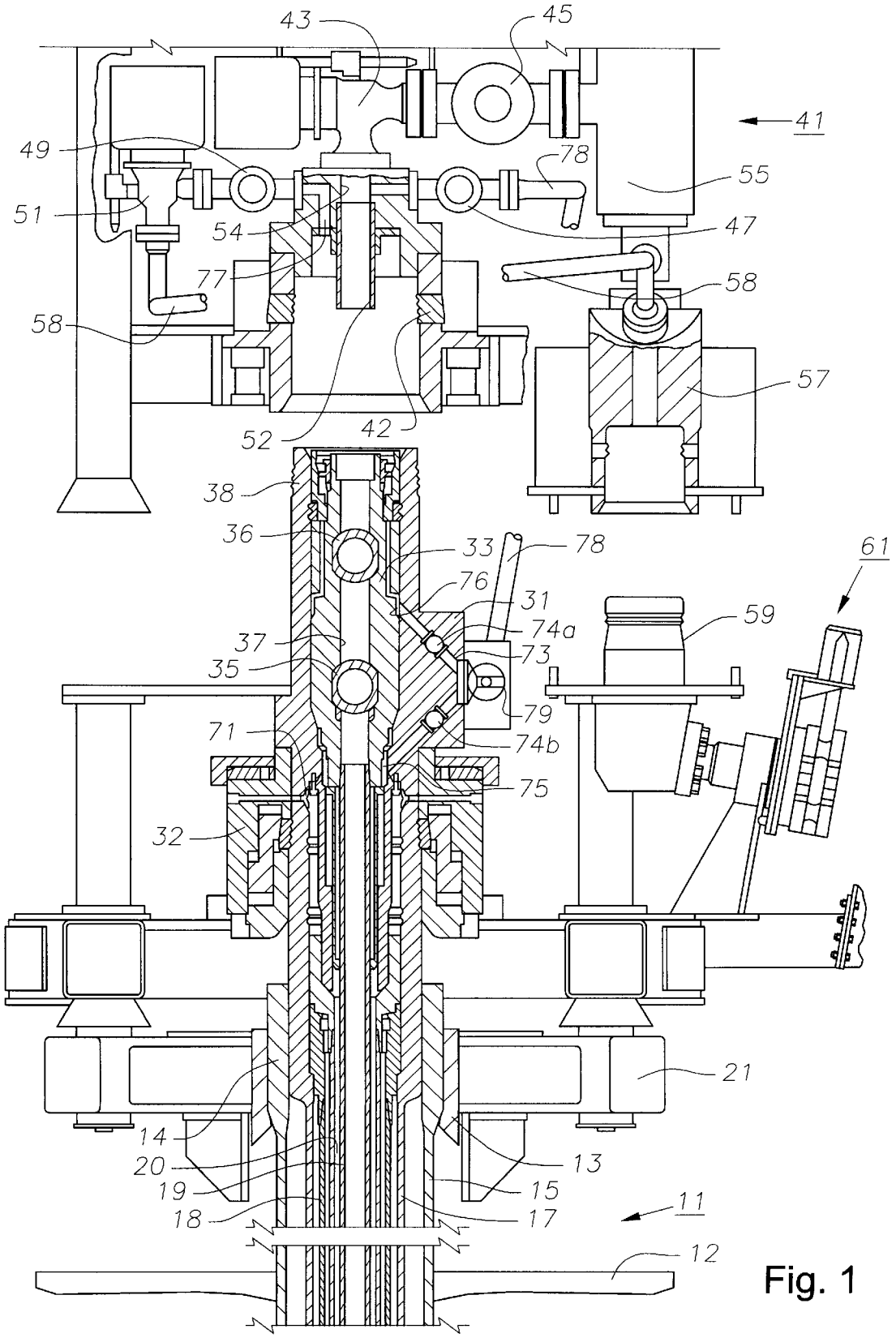
FIG. 1 is a front sectional view of the invention shown prior to make-up between the tree cap and the tree body.

Referring to FIG. 1, a subsea well 11 extending through the sea floor 12 is shown. Subsea well 11 has a guide base

21 which has a receptacle 13 that lands on an outer wellhead housing 14, supported on a string of conductor pipe 15. An inner or high pressure wellhead housing 17 lands in outer wellhead housing 14. Two casing strings 18 and tubing 19 are landed in inner wellhead housing 17. Tubing 19 has a tubing annulus 20 and is supported by tubing hanger 33 which lands in a subsea insert tree body 31. Tree body 31 is connected to inner wellhead housing 17 by a connector 32. Tubing hanger 33 has two ball valves 35, 36 which open and close a vertical bore 37 extending through tubing hanger 33. Tree body 31 has an upward protruding mandrel with an exterior connector profile 38.

A tree cap assembly 41 is lowered from a vessel, landed on tree body 31, and connected with a connector 42. Connector 42 slides over the mandrel of tree body 31 and secures to profile 38. Tree cap assembly 41 includes a plurality of gate valves including production choke valve 43, production wing valve 45, crossover valve 47, annulus wing valve 49, and annulus choke valve 51. Tree cap assembly 41 has a stinger 52 which inserts into tubing hanger bore 37. A protective canopy 54 covers tree cap assembly 41. Tree cap assembly 41 also contains a control pod assembly 53 (FIG. 2) and an optional multiphase flow meter 55. A dual bore flowline connector 57 extends below flow meter 55 and couples to a flowline mandrel 59 which is part of a flowline pull-in assembly 61. Assembly 61 faces laterally outward from tree body 31 and is mounted to guide base 21. An annulus line 58 extends between annulus choke valve 51 and one of the bores of flowline connector 57 for routing tubing annulus 20 to one of the flowlines (not shown) connected to assembly 61. The configuration of tree cap 41 can vary with more or less peripheral equipment being mounted on it to suit the application.

Figure 2:
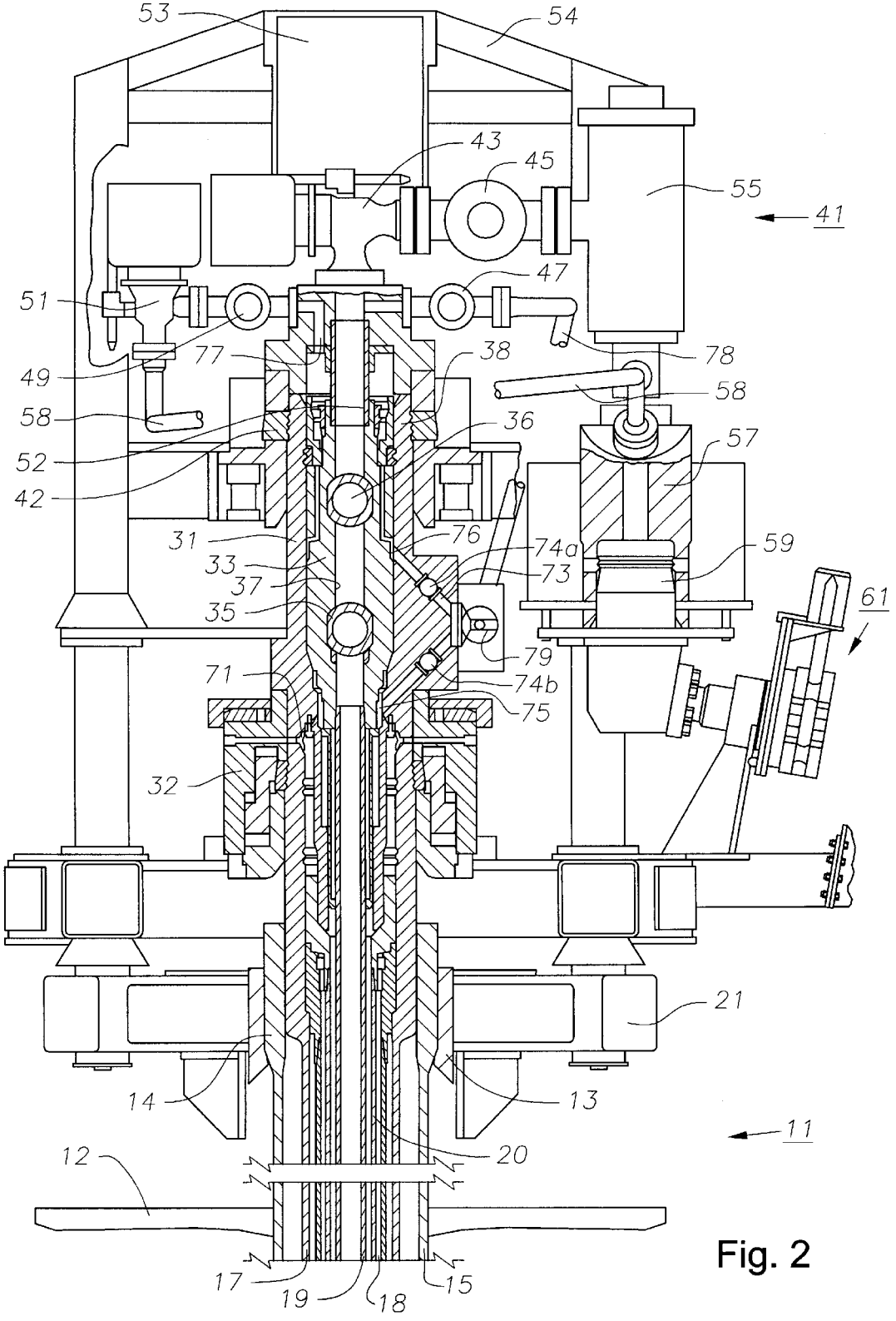
FIG. 2 is a front sectional view of the invention shown after make-up between the tree cap and the tree body.

Referring to FIG. 2, tree body 31 has a first set of angled tubing annulus bypass passages 73. Passages 73 extend from below the main tubing hanger seal 71 to the bore in tree 31 above tubing hanger 33. Communication to the angled bores 73 in tree body 31 is provided by a lower port 75 leading to tubing annulus 20 and upper ports 76 in tubing hanger 33. Ports 76 allow tubing annulus 20 communication from bypass passage 73 to above tubing hanger 33. Passages 73 have internal valves 74*a*, 74*b*, respectively, and join an external manifold 79. A second annulus bore 77 in tree cap 41 leads from the area in tree 31 around stinger 52 and thus communicates directly with ports 76. A cross-over line 78 extends from crossover valve 47 to manifold 79. Crossover valve 47 connects the lower annulus passages 73 to production flow passage 37.

In operation, the equipment is installed using techniques similar to horizontal tree installations. Well 11 is drilled and casing strings 18 are installed before the blowout preventer stack (not shown) is retrieved for running tree body 31. This installation operation could be achieved using a simple drill pipe tool, or, if rig space allows, it may be run below the stack. Drilling may be performed through tree body 31. A wear bushing (not shown) installed in tree body 31 while still at the surface would protect the internal profiles during final drilling operations. After drilling is complete, the wear bushing would be retrieved and tubing 19 would be installed. A concentric tubing hanger running tool (not shown) is used for installation. The tool has stabs to mate with production master valves 35, 36 control stabs. A subsea test tree (not shown) is also required in the running string for control during the perforation and test phase. When tree cap 41 is landed, flowline connector 57 simultaneously makes up with mandrel 59.

After testing, valves 35, 36 are closed to hold pressure in the well while the tubing hanger running tool, riser and blowout preventer stack are retrieved. Tree cap 41 would then be run on a simple drill pipe tool.

Production fluids flow up bore 37 and through valve 35, 36 before entering cap assembly 41 through stinger 52. The production fluid would then circulate through production choke valve 43, production wing valve 45, flow meter 55, flowline connector 57 and the flowline connected to flowline connector 61. Access to tubing annulus 20 is through passages 73, ports 76, passage 77, annulus wing valve 49, annulus choke valve 51, line 58, flowline connector 57, and out a separate flowline connected to connector 61. Crossover line 78 allows communication from tubing annulus 20 to production passage 37 by closing the upper valve 74*a*, opening the lower valve 74*b* and opening crossover valve 47.

Workover options for the equipment are also similar to those for horizontal trees. Tree cap 41 is removed after first shutting and testing valves 35. The blowout preventer stack is then installed and the monobore riser string with the subsea test tree and the tubing hanger running tool are landed and locked to tree body 31. The drilling rig communicates with tubing annulus 20 through passages 77, 76, 73, 75, and via the choke and kill line of the blowout preventer stack (not shown). Alternatively, wireline and coiled tubing intervention work could be carried using a conventional tree type lower riser or emergency disconnect package and riser run in open water. The open upper end of tree 31 has an inner diameter which is greater than or equal to an outer diameter of tubing hanger 33, thereby allowing tree cap 41 to be removed and tubing hanger 33 to be removed therethrough.

The invention combines the advantages of conventional trees and horizontal trees. The tree body has redundant valves in the vertical bore, providing the assurance associated with conventional trees during installation and workover when the tree is removed. The invention also allows easy retrieval of the tree cap on a simple tool and, thereafter, easy access to the tree body and production tubing for downhole workover. Since the tree is inline, the tubing hanger may be retrieved without removal of the tree. Moreover, the tree does not have wing outlets so it has no high sand erosion problems. Other than the annulus valves in the tree body, all potentially vulnerable valves and the multiphase flow meter are attached to the tree cap assembly for easy retrieval. Thus, the operational benefits of both conventional trees and horizontal trees are provided without the risk of a tree component failure demanding a long workover.

While the invention has been shown or described in only some of its forms, it should be apparent to those skilled in the art that it is not so limited, but is susceptible to various changes without departing from the scope of the invention.

I claim:

1. A well production tree, comprising:

a tree body having a vertical bore, an external connector profile and an open upper end;

a tubing hanger landed in the bore and having a vertical production passage in communication with a string of tubing;

a valve in the tubing hanger for opening and closing the production passage in the tubing hanger;

a tree cap having a receptacle which slides over the open upper end of the tree body;

a securing connector carried by the tree cap for engaging the connector profile of the tree body;

a production passage in the tree cap which is in fluid communication with the production passage of the tubing hanger; and a production valve carried by the tree cap for opening and closing the production passage in the tree cap.

2. The well production tree of claim 1, further comprising:

a first annulus passage leading from a tubing annulus surrounding the tubing to the open upper end of the tree body above the tubing hanger;

a second annulus passage extending through the tree cap in communication with the first annulus passage; and at least one annulus valve carried by the tree cap for opening and closing the second annulus passage.

3. The well production tree of claim 2, further comprising:

a crossover passage leading from the first annulus passage to the production passage in the tree cap; and a crossover valve carried by the tree cap for opening and closing the crossover passage.

4. The well production tree of claim 1, further comprising a stinger for connecting the production passage of the tree cap to the production passage of the tubing hanger.

5. The well production tree of claim 1, further comprising a flowline connector mounted to the tree cap; and a flowline mandrel located adjacent to the tree body for engaging the flowline connector when the tree cap is installed on the tree body.

6. The well production tree of claim 5 wherein the flowline connector directly engages the flowline mandrel with downward vertical movement as the tree cap is installed on the tree body.

7. The well production tree of claim 1, further comprising a production choke carried by the tree cap and located in the production passage of the tree cap.

8. The well production tree of claim 1, further comprising:

an annulus bypass passage extending through the tree body and leading from a tubing annulus surrounding the tubing to the bore of the tree body above the tubing hanger.

9. The well production tree of claim 1 wherein the securing connector has an inner groove profile and moves radially to engage the outer connector profile on the tree body.

10. The well production tree of claim 1 wherein the open upper end of the tree body has an inner diameter which is greater than or equal to an outer diameter of the tubing hanger, thereby allowing the tree cap to be removed and the tubing hanger to be removed therethrough.

11. A well production tree, comprising:

a tree body having a vertical bore, an external connector profile and an open upper end;

a tubing hanger landed in the bore and having a vertical production passage in communication with a string of tubing;

a valve in the tubing hanger for opening and closing the production passage in the tubing hanger;

a tree cap having a receptacle which slides over the open upper end of the tree body;

a securing connector carried by the tree cap for engaging the connector profile of the tree body;

a production passage in the tree cap which is in fluid communication with the production passage of the tubing hanger, the production passage of the tree cap extending upward and laterally away from the tree cap;

a production valve carried by the tree cap for opening and closing the production passage in the tree cap;

a first annulus passage leading from a tubing annulus surrounding the tubing to the open upper end of the tree body above the tubing hanger;

a second annulus passage extending through the tree cap in communication with the first annulus passage; and at least one annulus valve carried by the tree cap for opening and closing the second annulus passage.

12. The well production tree of claim 11, further comprising:

a crossover passage leading from the first annulus passage to the production passage in the tree cap; and a crossover valve carried by the tree cap for opening and closing the crossover passage.

13. The well production tree of claim 11, further comprising a stinger for connecting the production passage of the tree cap to the production passage of the tubing hanger.

14. The well production tree of claim 11, further comprising a flowline connector mounted to the tree cap; and a flowline mandrel located adjacent to the tree body for engaging the flowline connector when the tree cap is installed on the tree body.

15. The well production tree of claim 14 wherein the flowline connector directly engages the flowline mandrel with downward vertical movement as the tree cap is installed on the tree body.

16. The well production tree of claim 11, further comprising a production choke carried by the tree cap and located in the production passage of the tree cap.

17. The well production tree of claim 11 wherein the first annulus passage comprises:

an annulus port extending through the tubing hanger from its outer surface to its upper end; and an annulus bypass passage extending through the tree body and leading from the tubing annulus surrounding the tubing to the annulus port.

18. The well production tree of claim 11 wherein the open upper end of the tree body has an inner diameter which is greater than or equal to an outer diameter of the tubing hanger, thereby allowing the tree cap to be removed and the tubing hanger to be removed therethrough.

19. A well production tree, comprising:

a tree body having a vertical bore, an external connector profile and an open upper end;

a tubing hanger landed in the bore and having a vertical production passage in communication with a string of tubing;

a valve in the tubing hanger for opening and closing the production passage in the tubing hanger;

a tree cap having a receptacle which slides over the open upper end of the tree body;

a securing connector carried by the tree cap for engaging the connector profile of the tree body;

a production passage in the tree cap which is in fluid communication with the production passage of the tubing hanger, the production passage of the tree cap extending upward and laterally away from the tree cap;

a production valve carried by the tree cap for opening and closing the production passage in the tree cap;

an annulus bypass passage extending through the tree body and leading from a tubing annulus surrounding the tubing to the bore of the tree body above the tubing hanger;

an upper annulus passage extending through the tree cap in communication with the annulus bypass passage;

at least one annulus valve carried by the tree cap for opening and closing the upper annulus passage;

a crossover passage leading from the annulus bypass passage to the production passage in the tree cap;

a crossover valve carried by the tree cap for opening and closing the crossover passage;

a stinger for connecting the production passage of the tree cap to the production passage of the tubing hanger;

a flowline connector mounted to the tree cap; and a flowline mandrel located adjacent to the tree body for engaging the flowline connector when the tree cap is installed on the tree body.

20. A method for completing a subsea well, comprising:

(a) providing a tree body having a vertical bore, an external connector profile and an open upper end and positioning the tree body on a wellhead housing on a sea floor at an upper end of a well;

(b) providing a tubing hanger having a production passage and a valve in the production passage, and landing the tubing hanger in the bore of the tree and closing the valve in the tubing hanger;

(c) providing a tree cap with a production passage having a production valve;

(d) lowering and securing the tree cap onto the tree body;

(e) opening the valve in the tubing hanger and the production valve in the tree cap; and then (f) circulating production fluid through the production passage of the tubing hanger and the tree cap to a flowline assembly.

21. The method of claim 20 wherein step (d) further comprises connecting the production passage of the tree cap to the flowline assembly while lowering the tree cap onto the tree body.

22. A well production tree comprising:

a tree body having a vertical bore and an open upper end;

a tubing hanger landed in the bore and having a vertical production passage in communication with a string of tubing;

a valve in the tubing hanger for opening and closing the production passage in the tubing hanger;

a tree cap disposed upon the open upper end of the tree body;

a production passage in the tree cap which is in fluid communication with the production passage of the tubing hanger; and a production valve carried by the tree cap for opening and closing the production passage in the tree cap.

23. The well production tree of claim 22 further comprising a securing connector to secure the tree cap to the tree body.

24. The well production tree of claim 22 wherein the tree body further comprises an external connector profile for engaging the securing connector.

25. The well production tree of claim 22 wherein the tree cap further comprises a receptacle that slides over the open upper end of the tree body.

26. A well production tree comprising:

a tree body having a vertical bore therethrough;

a tubing hanger landed in the bore and having a vertical production passage in communication with a string of tubing;

a tree cap to be affixed to the tree body, the tree cap having a production passage that is in fluid communication with the production passage of the tubing hanger; and a flowline connector mounted to the tree body for engaging a flowline mandrel located adjacent the flowline connector when the tree cap is secured to the tree cap.

27. The well production tree of claim 26 wherein the tree cap comprises a receptacle to slidingly engage a portion of the tree body.

28. The well production tree of claim 27 further comprising a securing connector for securing the tree cap and tree body together.

29. The well production tree of claim 26 further comprising a production valve carried by the tree cap for opening and closing the production passage in the tree cap.

* * * * *